United States Patent [19]

Rasmussen

[11] 3,956,861

[45] May 18, 1976

[54] TRIM ARRANGEMENT FOR INTERIOR PARTITIONS

[76] Inventor: Robert R. Rasmussen, 1120 Grandview Lane, Lake Forest, Ill. 60045

[22] Filed: Sept. 23, 1974

[21] Appl. No.: 508,440

Related U.S. Application Data

[63] Continuation-in-part of Ser. No. 337,598, March 2, 1973, Pat. No. 3,861,103.

[52] U.S. Cl. ..... 52/287; 52/241; 52/288; 52/717

[51] Int. Cl.[2] ..... E04B 2/74

[58] Field of Search ..... 52/287, 288, 717, 718, 52/716

[56] References Cited

UNITED STATES PATENTS

| | | | |
|---|---|---|---|
| 3,074,521 | 1/1963 | Woods | 52/287 |
| 3,201,909 | 8/1965 | Grun | 52/287 |
| 3,405,488 | 10/1968 | Nelson | 52/287 |
| 3,444,657 | 5/1969 | Swanson | 52/288 |
| 3,505,773 | 4/1970 | Thomas | 52/717 |

FOREIGN PATENTS OR APPLICATIONS

| | | | |
|---|---|---|---|
| 679,523 | 10/1966 | Belgium | 52/287 |
| 409,340 | 10/1966 | Switzerland | 52/287 |
| 960,065 | 5/1964 | United Kingdom | 52/288 |

*Primary Examiner*—John E. Murtagh
*Attorney, Agent, or Firm*—Mann, Brown & McWilliams

[57] ABSTRACT

A trim arrangement for interior partitions comprising a trim member of resiliently flexible generally planar construction having a pair of outwardly facing upper and lower trim walls juxtaposed to and separated by a continuous slot extending longitudinally of the member, which slot exposes a rearwardly inset continuous anchoring wall defining on the rearwardly facing side of the trim member a rearwardly facing seating surface that is straddled on either side of same by bracing flanges, all of which are applied against the partition wall surface when the trim member is secured to the partition wall surface by applying fasteners at random positions along the anchoring wall through the slot, with a seal strip being force fitted into locking arrangement within the slot to mask the fasteners along the length of the trim member. The trim member in one form is applied along the lower edge of the partition as a base trim and in this form the upper trim wall arcs rearwardly to meet with the partition wall surface, and the lower trim wall is in substantial parellelism with the plane of the trim member for its width and meets the floor. In another form the trim member is applied at chair back top level to serve as a chair rail, and in this form the upper and lower trim walls are the same as the upper trim wall for the base trim.

At corners, adjacent ends of the trim members have a corner type trim section secured to the partition walls free of connection to the trim members and in slip fit relation to the trim members to accommodate relative movement of the partition walls due to drift, seismic shock, thermal movement, and the like.

11 Claims, 15 Drawing Figures

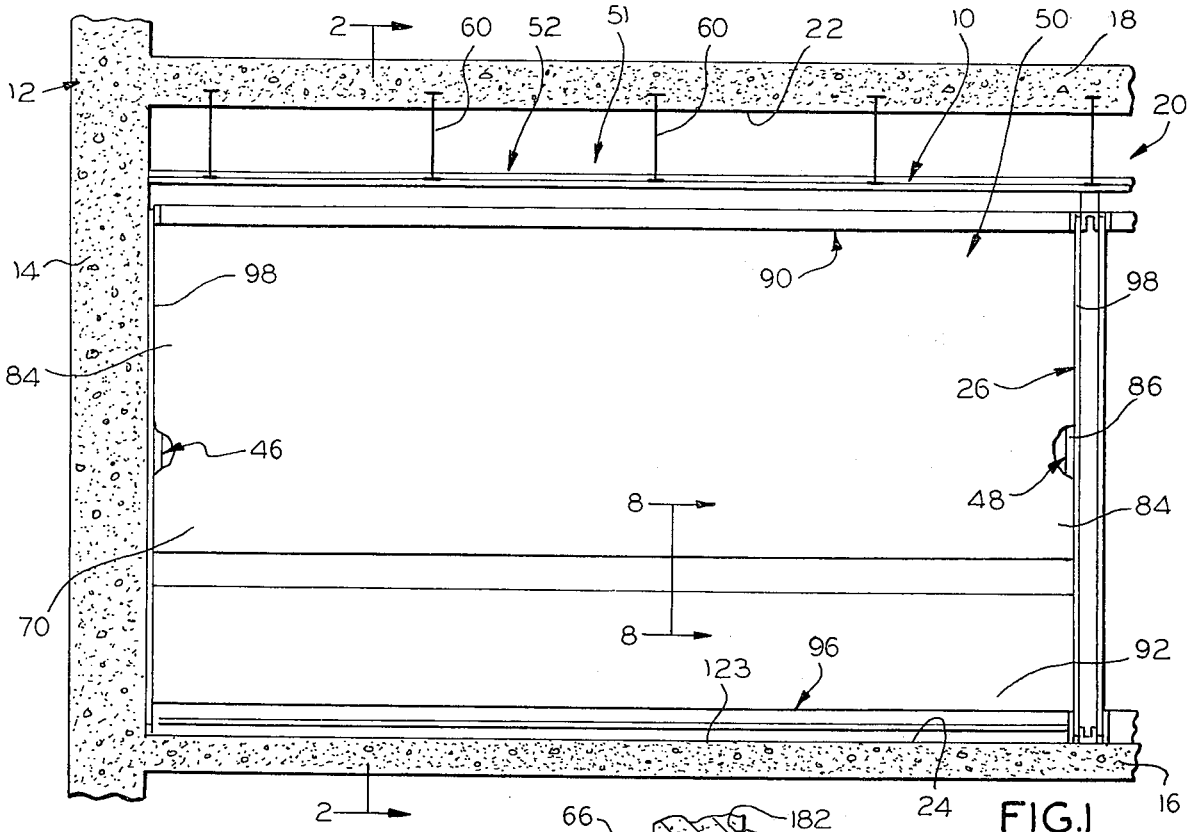
FIG.1
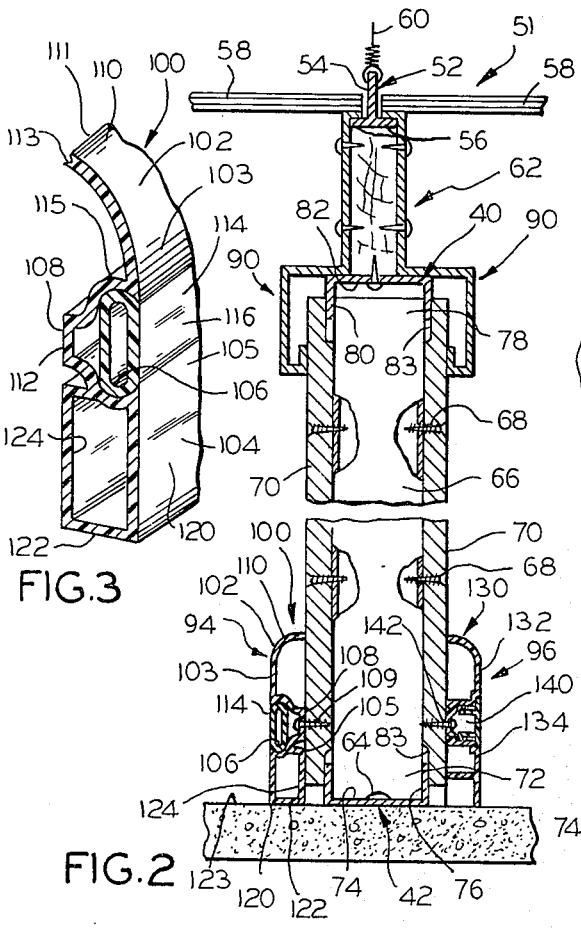
FIG.3
FIG.2
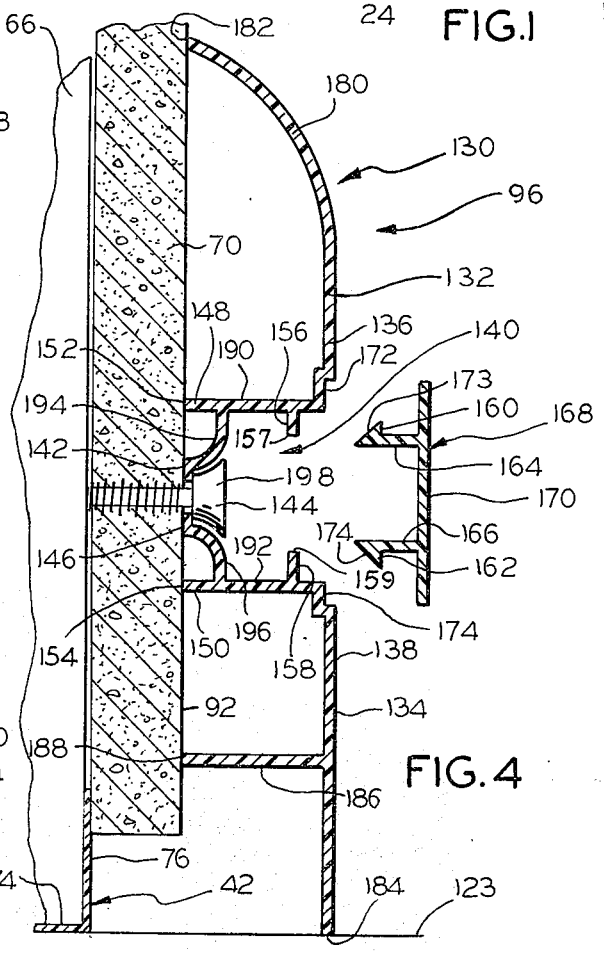
FIG.4

TRIM ARRANGEMENT FOR INTERIOR PARTITIONS

This application is a continuation-in-part of my application Ser. No. 337,598, filed Mar. 2, 1973, now Pat. No. 3,861,103, granted Jan. 21, 1975.

This invention relates to a trim arrangement for interior partitions, and more particularly, to a trim arrangement that is particularly adapted for use in buildings employing dry wall construction type partitions.

Modern high rise construction commonly involves basic floor, ceiling, and side walls (the building superstructure), leaving much of the floor space of the individual floors to be subdivided by dry wall partitions that are adapted for ready disassembly to accommodate redesign of floor layouts.

Such partitions commonly comprise wallboard sheets of the dry wall type secured to studs that are in turn applied to floor and ceiling runners suitably secured in place.

The nature of such construction makes it desirable that the wallboard be trimmed or covered at the edges of the wall surfaces involved to mask gaps and uneven fits at floors, ceilings, and side walls.

My said application Ser. No. 337,598 discloses a floating type of partitioning arrangement in which the floor, ceiling and side wall runners are mounted in coplanar arrangement in association with a building floor, ceiling, and side walls (of the room space being partitioned), and a partition panel assembly, comprising metal channel studding having the usual spacing and covered by wallboard sheeting, is positioned between and within said runners, in which the panel assembly rests on the floor runner is free of fixed connection to any of the runners, whereby the runners are free to shift with the building relative to the panel assembly under the action of drift, seismic shock, thermal movement, and the like.

The panel assembly has its studs received in the floor and ceiling runners, but the studs extend short of columnar engagement or supporting relation with the ceiling runner. The wallboard sheeting frictionally engages all runners for good acoustical characteristics, but is spaced from the adjacent building ceiling, floor and side walls to leave a gap that accommodates the floating action contemplated by the invention of said application. At the sides of the partition the gap is closed by a wallboard supported trim piece for masking the side runners and the rough cut edge of the wallboard, and suitable resilient caulking material. Associated with the upper and lower margins of the panel assembly are the trim members that mask the ceiling and floor runners respectively as well as the corresponding edges of the wallboard and are formed and/or secured to accommodate the floating action contemplated by the invention of said application.

The present application is concerned with improvements in the floor or base trim of my said application, and a modification of the general structure arrangement involved that especially adapts same for use as a chair rail.

A principal object of this invention is to provide a basic wallboard trim arrangement of light weight simplified construction that may be provided in standard selected lengths for cut to fit application to specific room layouts.

Another principal object of the invention is to provide a wallboard trim arrangement that is arranged for application thereto, at random points therealong, fasteners for securing same to the wallboard that are fully masked in finished form.

Still anotehr principal object of the invention is to provide a slip fit corner arrangement for trim of the type indicated which avoids job side cut mitered trim corners and the unsightly gaps frequently experienced with same, and which accommodates relative movement of the wallboard at partitioning corners without creating unsightly gaps.

In accordance with this invention, a trim arrangement is provided which, while being especially adapted for use in connection with the floating partition arrangement of the said application, is of general application to dry wall type partitioning. The trim comprises a trim member of resiliently flexible generally planar construction having a pair of outwardly facing upper and lower continuous trim walls juxtaposed to and separated by a continuous, slot extending longitudinally of member, which exposes a rearwardly inset continuous anchoring wall defining on the rearwardly facing side of same a planar seating surface that is straddled on either side of same with spaced apart bracing flanges, all of which are applied against the partition wall surface when the trim member is secured in place, this being done by applying fastening screws in random positions along the length of the anchoring wall through the indicated slot. This slot is closed by a continuous seal strip that has snap in place cooperation with the trim member and is recessed into the trim member in flush relation with the trim walls of same.

In one basic form of the trim member, the trim member is formed to serve as the base trim and for this purpose one of its trim walls is arced rearwardly of same into the plane of the anchor wall seating surface, and the other trim wall extends straight down for meeting with the floor, and is braced by a horizontally disposed flange that is spaced about the lower floor meeting edge of the base trim.

In another form of the trim member, both trim walls arc rearwardly of the trim member, in an equal but opposite manner, into the plane of the anchor wall seating surface, and the member is applied at chair back top level to serve as a chair rail.

At the corners of a room space considered, the ends of the trim members have corner type trim sections secured to the partition walls free of connection to the respective trim members, and in slip fit relation to the trim members, to accommodate relative movement of the partition walls. The corner trim sections are separate and distinct from the respective trim members that serve as the base and chair rail trim and avoid unsightly gaps that trim mitering at wall corners has frequently resulted when standard practices are employed.

Other objectives , uses, and advantages will be obvious or become apparent from a consideration of the following detailed description and the application drawings. In the drawings:

FIG. 1 is a fragmental vertical sectional view through a typical high rise building showing an outside wall of same at one of the floors thereof, with a room partition wall formed as disclosed in my said application and trimmed in accordance with the present invention.

FIG. 2 is a vertical sectional view taken substantially along line 2—2 of FIG. 1, but on an enlarged scale and with parts broken away, and showing the base trim of my said application at one side of the partitioning and an improved form of base trim on the other side of the partition;

FIG. 3 is a fragmental sectional isometric view illustrating the base trim of my said application;

FIG. 4 is a sectional view similar to that of FIG. 2 but illustrating the base trim of the present invention on an enlarged scale, and as applied to the wallboard partition of FIG. 1;

Figure 5:
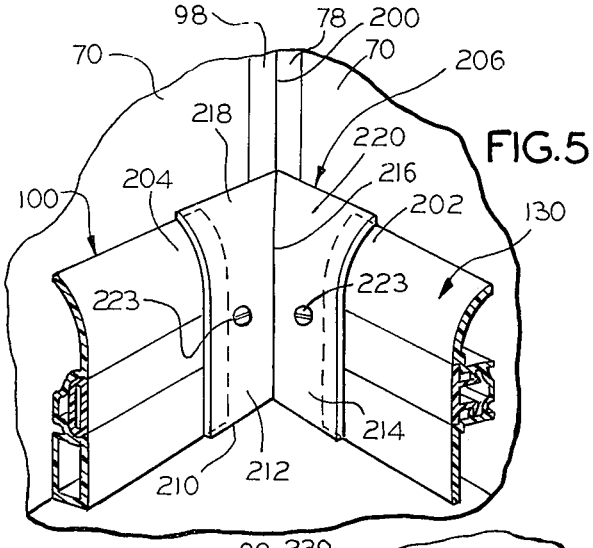
FIG. 5 is a diagrammatic perspective view illustrating the base trims of FIGS. 3 and 4 in association with a corner trim section for an internal room corner.

However, it is to be distinctly understood that the specific drawing illustrations provided are supplied primarily to comply with the requirements of the Patent Laws, and that the invention may have other embodiments that will be obvious to those skilled in the art, and which are intended to be covered by the appended claims.

Reference numeral 10 generally indicates a floating partition arrangement of the general type disclosed in my said application applied to a high rise building 12 of familiar reinforced concrete construction defining outer wall or columns 14 and floor walls 16 and 18 which, together with the other buildings walls not shown, define a floor space 20 in which the partition arrangement is mounted. The floor walls 16 and 18 thus define for the space 20 a ceiling 22 and floor 24. A second room dividing partition embodying the invention of said application is indicated by reference numeral 26 disposed at right angles to the partition arrangement 10 to serve as a cross wall in subdividing room space 20.

The partition arrangement 10 (and thus also the partition arrangement 26) comprises a ceiling runner 40 (see FIG. 2), a floor runner 42 and side wall runners 46 and 48 (see FIG. 1) mounted in coplanar relation, and mounting between same a partition panel assembly 50 which rests on the floor runner 42, but which is free of fixed connection with respect to any of the runners 40, 42, 46 and 48 that engage same, so that the runners for each partition arrangement are free to shift relative to the respective panel assemblies 50 as the building 12 and its floor walls and side walls shift laterally of FIG. 1 due to drift, seismic occurrences, thermal movement, and the like.

In the general arrangement of FIG. 1, the partition arrangement 10 is specifically adapted for use in connection with a conventional suspended ceiling of the "T" grid lay-in tile type, generally indicated at 51, in which the T grid construction comprises a plurality of interconnected T bars 52 each defining an upwardly directed main flange 54 and laterally directed support flanges 56 (see FIG. 2) on which rest the conventional ceiling tile 58. The T bars 52 are supported from the ceiling wall 18 by supporting wires 60 suitably anchored in the floor wall involved.

In the partition arrangement 10, the ceiling and floor runners 40 and 42, which are of standard channel-shaped construction, are suitably fixed in place. In the specific form shown in FIGS. 1 and 2, the ceiling runner is affixed to the blocking 62 of my said application that is suspended from the suspended ceiling 51 by being operatively associated with one of the T grid members 52, as specifically disclosed in said application. The floor runner is fixed in position by employing suitable fasteners such as ram set nails 64. The side wall runners are also of standard channel-shaped construction with the side wall runners being suitably affixed in place as disclosed in said application, the disclosure of which is hereby incorporated herein by this reference.

The panel assembly 50 comprises studs 66 of the familiar channel-shaped construction having the usual spacing (for instance, 16 inches on centers), which have secured thereto, as by employing suitable screws 68, the wallboard sheets 70.

The studs 66 of the panel assemblies 50 as their lower ends 72 rest on the web 74 of the floor runner and between its side flanges 76, but at their upper ends 78, the studs 66, while being received between the runner flanges 80, extend short of the ceiling runner web 82. The studs 66 at their upper and lower ends are in frictional slip fit relation with respect to the floor and ceiling runner flanges, and the wallboard sheeting 66 extends short of both the ceiling and floor, but is in frictional slip fit relation with the side flanges of the floor and ceiling runners.

At the building side walls, the ends 84 of the wallboard sheeting on either side of the assembly 50 extend beyond the end studs of the assembly and receive between them the side flanges 86 of the side runners. As disclosed in said application the sheeting also extends short of the cross walls involved.

In accordance with the invention of said application, there is operatively associated with the ceiling runner 40 on either side of same a trim member 90 that is in slip fit relation with the wallboard sheeting 66. At the bottom margin 92 of the assembly 50, base trim members 94 and 96 are applied to the sheeting 66. The sheeting at the side margins 84 of the assembly 50 have trim strips 98 applied to same, with a suitable resilient caulking material (not shown) filling the gaps between strips 98 and the cross walls involved, as disclosed in said application.

The invention of the present application is concerned with the general arrangement of the base trim members 94 and 96, the manner of application of same to the panel assembly 50, and the adaption of the general arrangement of trim member 96 to chair rail use.

The base trim member 94 is that disclosed in my said application and comprises a strip member 100 of relatively stiff but resiliently flexible generally planar construction, which may conveniently be extruded from rigid vinyl or the like and have its various walls proportioned in thickness so that it is resiliently flexible in nature. The member 100 is arranged to accommodate the floating movement between the floor wall 18 and the panel assembly 50 that is contemplated by the invention of said application, and yet insure full masking of the lower margin of the panel assembly 50 and the floor runner 42.

The trim member 100 generally comprises upper and lower trim walls 102 and 104 having portions 103 and 105 which are generally parallel to the plane of the trim member and which are separated by a groove or slot 106 which exposes a rearwardly inset anchor wall 108 that is to receive suitable fastening screws 109, such as those of the so-called bugle head high-low thread type frequently used in connection with dry wall, in random spacing therealong to secure the base trim in place, with trim wall 104 engaging floor 24. In the form shown, the strip member, 100 has trim wall 102 arched as at 110, rearwardly thereof, for engagement with the sheeting 70 to which it is applied. Strip 100 is preferably shaped in its unstressed relation, so that its rearwardly projecting edge 111 projects somewhat beyond the plane of anchoring wall 108, so that on application of screws 109 to secure member 100 to sheeting 70, the trim member edge 111 is drawn firmly against sheet 70. Edge 111 may be recessed as at 113 for good engagement with sheeting 70.

The anchoring wall 108 of member 100 defines a rearwardly facing seating surface 112 which seats against the sheeting 70 in being applied thereto.

The slot 106 of member 100 is of the dovetail type and is adapted to receive a sealing strip 114 in snap fit relation thereto, which strip 114 may be formed from any suitable resiliently compressible material, such as vinyl, for the purpose of concealing the fasteners applied to the wall 108. Strip 114 has a length to extend the full length of trim member 100.

The strip 114 is shaped to substantially complement the shape of the outer portion of the slot 106, and the parts involved are arranged so that the strip 114 can readily be snap fitted into the slot 106 from the outwardly facing side of member 100. Strip 114 is shaped to have its outwardly facing surface or face 116 flush with the trim wall members 103 and 105, as indicated in FIG. 3, whereby the strip 114 is fully set back into the trim member 100 to avoid accidental dislodgement by being accidentally struck by passersby. Strip 114 is tubular in nature and defines a masking wall 115 defining face 116.

The trim member 100 in the form shown has its trim wall 104 as part of a tubular base portion 120 having a planar abutment wall 122 that engages the upper surface 123 of the floor wall 18, and a back wall 124 which is in the plane of anchor wall 108 and thus engages the sheeting 70 to the extend that the sheeting 70 extends below the upper end of the wall 124; the shape of base portion is such as to resist being kicked under the lower edge of sheeting 70.

The base trim 96 comprises an improved trim member 130 (see FIG. 4) which is also formed by being extruded from rigid vinyl, with its walls proportioned to have the member of relatively stiff but resiliently flexible nature. Member 130 comprises upper and lower trim walls 132 and 134 having coplanar portions 136 and 138, which are vertically disposed when the member 130 is applied to the sheeting 70. The member 130 is formed to define slot 140 which exposes anchor wall 142 to which screw type fasteners 144 (which preferably are of the same type as fasteners 68) are applied at random positions along the length of the anchor wall 142. Anchor wall 142 defines a rearwardly facing seating surface 146, which seats against the sheeting 70, and which has disposed on either side of same bracing flanges 148 and 150 terminating in seating edges 152 and 154, respectively, that lie in the plane of the seating surface 146.

The trim member 130 within the slot 140 is formed to define opposed spaced apart coplanar stub flanges 156 and 158 which cooperate with the lug portions 160 and 162 of spaced apart parallel locking flanges 164 and 166 of seal strip 168, which in addition to the flanges 164 and 166 defines planar masking wall 170, which is adapted to seat into recesses 172 and 174 that are defined by the trim walls 132 and 134 along the margins of the slot 140, so as to dispose the masking wall 170 of the seal strip 168 in coplanar flush relation with the trim walls 132 and 134.

The lug portions 160 and 162 of the locking flanges 164 and 166 are formed with the respective cam surface 173 and 174 adapted for camming relation with the stub flanges 156 and 158, respectively, whereby when the strip 168 is finger or thumb pressed into place along the slot 140, the seal strip lug portions 160 and 162 snap behind the stub flanges 156 and 158 in locking relation thereto to hold the seal strip 168 against dislodgement in such a manner that a prying tool is required to remove the seal strip. Strip 168 and its flanges 164 and 166 extend the length of trim member 130.

It is to be noted that stub flanges 156, 158 each define the respective squared edge portions 157 and 159 behind which the respective lug portions 160 and 162 seat see FIGS. 2 and 5); stub flanges 156 and 158 and their respective lug portions 160 and 162 are formed to define internal right angle or squared corners with which the respective squared end portions cooperate when the seal strip 168 is pressed into place to preclude the possibility that building movements (of the type indicated), by themselves, will effect dilodgement of the seal strip 168.

In the trim member arrangement of FIG. 4, the upper trim wall 132 includes arced upper portion 180 which meets sheeting 70, and which has its marginal edge 182 disposed in close fitting relation with the sheeting 70, as indicated in FIG. 4. For this purpose, member 130 is formed so that in its unstressed state, edge 182 projects beyond the plane of anchoring wall 142, so that when member 130 is secured to sheeting 70, edge 182 bears firmly against the sheeting and is, of course, disposed in the plane of anchor wall 142.

The lower trim wall 134 is substantially planar for its width (the vertical dimension of FIG. 4) and terminates in lower marginal edge 184 that meets the floor surface 123; while flush engagement of edge 184 with floor surface 123 is not necessary along the full length of member 130, close juxtaposition is desirable. The lower trim wall 134 includes an integral rearwardly directed brace flange 186 having a rearwardly directed marginal edge 188 adapted for engagement with the sheeting 170 in the manner indicated in FIG. 4, to brace the trim wall 134 parallel to the sheeting 70. For this purpose, member 130 is preferably formed so that in its unstressed state, edge 188 projects rearwardly of anchor wall 146, so that when member 130 is secured in place edge 188 bears firmly against sheeting 70, and trim wall 134 is substantially upright; in this position edge 188 is in the plane of anchor wall 142.

The upper and lower trim walls 132 and 134 are formed with the respectively rearwardly projecting walls 190 and 192 that are coplanar and integral with the respective brace flanges 148 and 150, and that are connected together by their respective arc walls 194 and 196 which in turn are integrally connected with the anchor wall 142. The arc walls 194 and 196 are made to complement the exterior shape of the heads 198 of the bugle head screws 144 that are illustrated, which are preferably of the high low thread type commonly used in connection with wallboard sheeting of the type indicated at 70, as previously indicated.

The base trims 94 and 96 and their sealing strips 114 and 168 are preferably formed, by extrusion, in standard lengths, and the strips 114 and 168 may be applied to their respective trim members prior to shipment so that separate handling of the sealing strips is avoided. When the trims 100 and 130 are to be employed along the lower marginal edges 92 of the sheeting 70, they may be readily cut to the desired lengths, utilizing a suitable shearing tool (such as a hand operated tin snipper), with the seal strips remaining in place, and after the seal strip of the shortened trim member is removed, the trim member is applied to the sheeting 70 in the manner indicated so as to extend between but just short of opposing cross walls of the room. When this has been completed, the respective seal strips 114 and 168 are applied to the respective trim members 100 and 130 by snapping them into the recess flush portions indicated in FIGS. 3 and 4, respectively. This may be done by starting the seal strip at one end of the respective trim members and sliding one's thumb along the seal strip to press the seal strip into its intended seated relation.

If so desired, telephone cables may be applied between the respective trim walls 102 and 130 and the sheeting 70. The resilient trim walls involved may be readily separated from the wallboard 70 by sliding a finger behind it and placing the cable as the sliding action proceeds along the respective trim members. The trim member trim walls involved snap back into place to suit their resilient construction.

As a manufacturing expedient, in order to obtain the firm engagement with the sheet 70 that is desired for trim edges 182 and 188, the member may be shaped by its extruding process so that in its free form it is slightly convex along its side bearing walls 132 and 134, with the shaping being such that when the trim member is secured in place, walls 132 and 134 will be in substantially coplanar relation.

Further in accordance with this invention, the wallboard 70 at the corners defined by the partition assemblies 50 (or other types of wallboard partitions that may be involved) has operatively associated therewith corner trim sections of the type shown in FIGS. 5 – 8.

Figure 6:
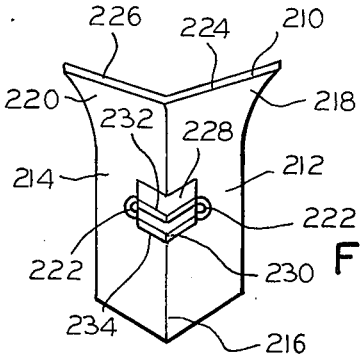
FIG. 6 is a rear view of the corner trim section shown in FIG. 5.

In the form of FIGS. 5 and 6, the corner trim section, is for inside or internal paneling corners 200. The trim members 100 and 130, as the case may be, are extended toward the corner 200, but have their terminal end portions 202 and 204 disposed short of same, as indicated in FIG. 5.

Applied over the trim members 100 and 130 is a corner trim section 206 which, in accordance with this invention, is secured to the paneling 70 free of connection to the respective trim members 100 and 130.

The corner trim section 206 generally comprises a one piece element 210 defining a pair of trim walls 212 and 214 disposed at right angles to each other and intersecting at corner 216. The upper portions 218 and 220 of the trim walls 212 and 214 are arced rearwardly of same in a manner to complement the arced configuration of the trim walls 102 and 132 of the respective trim members 100 and 130.

The trim walls 212 and 214 are each formed with a screw receiving opening or aperture 222 (see FIG. 6) through which suitable attachment screws (such as the familiar hi-lo thread dry wall type screws) 223 may be applied to secure the corner trim section 206 to the respective sheetings 70 forming the corner 200.

As indicated in FIG. 6, the arced portions 218 and 220 terminate in edge portions 224 and 226 which are to engage the sheeting 70, and in between the screw opening 222, the section defines a pair of spaced apart, parallel, bracing flanges 228 and 230, projecting normally of the trim walls 212 and 214 and each defining angular marginal edges 232 and 234 that also engage the sheetings 70 when the screws 223 are turned into place into sheeting 70. The flanges 228 and 230 are proportioned such that their edges 232 and 234 are disposed in coplanar relation with the respective edges 224 and 226 on either side of the section 206 whereby as the screws 223 are turned into place, the corner section 206 has its trim walls 214 and 212 drawn firmly against the ends 202 and 204 of the respective trim members 130 and 100, and the marginal edges 224, 226, 232 and 234 are applied against the sheetings 70.

Figure 7:
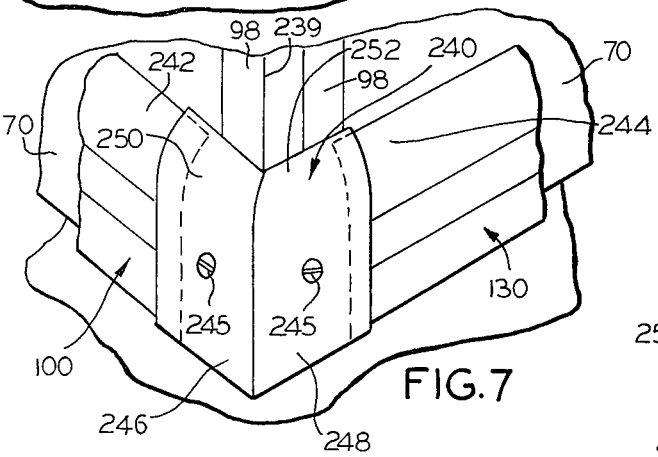
FIG. 7 illustrates base trim members of the types shown in FIGS. 3 and 4 in association with an external type corner trim section.
Figure 8:
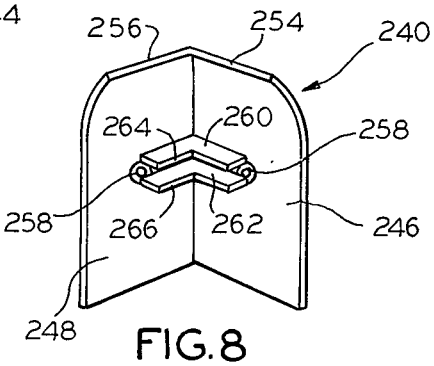
FIG. 8 is a view of the rear side of the corner trim section shown in FIG. 7.

In the form of FIGS. 7 and 8, the trim members 100 and 130 cooperate with a corner trim section 240 of the external corner type. In this form of the invention, the ends 242 and 244 of the respective trim members 100 and 130 extend adjacent to but short of the external corner 239 and are covered by the corner section 240 that is secured in place (to sheetings 70) by employing appropriate screws 245.

The corner section 240 is generally similar to corner section 206 except that it is shaped oppositely for external corner application and thus comprises trim walls 246 and 248 that have their upper portions 250 and 252 arced rearwardly of same for masking cooperation in a complementary manner with the upper trim walls of the respective trim members 100 and 130 and bearing engagements with sheeting 70 forming corner 239. The trim walls 250 and 252 define upper marginal edges 254 and 256 that engage the sheetings 70. Trim walls 248 and 246 are each formed with screw receiving holes 258 that receive the respective screws 245, with the respective parallel bracing flanges 260 and 262 (which extend normally of walls 250 and 252) projecting rearwardly of the respective trim walls 248 and 246 for application against the sheetings 70 in corner like configuration.

The bracing flanges 260 and 262 each define marginal edge portions 264 and 266 that are coplanar with the respective wall edge portions 254 and 256 whereby as screws 245 are tightened into place (into sheetings 70), the trim walls 246 and 248 bear against the respective ends 242 and 244 of the trim members 100 and 130, and the corner section marginal edges 254, 256, 264 and 266 are drawn against the sheetings 70 in bracing relation thereto.

As was the case with the trim corner section 206, trim corner section 240 is thus affixed to the sheeting 70 independent and free of connection to the respective trim members 100 and 130 and in slip fit relation thereto. It will thus be seen that relative shifting movement between the trim members 100 and 130 and the respective corner sections 206 and 240, is permitted, as such may be induced due to building drift, etc.

Furthermore, the corner sections 206 and 240 avoid mitering of the trim members 100 and 130 at the corners 200 and 239, which thus avoid the resulting corner gaps that are so frequent occurrence at corner mitering.

Figure 9:
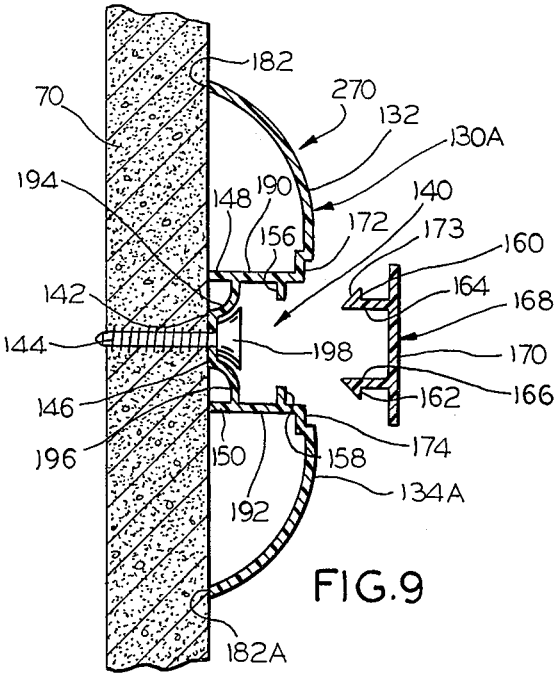
FIG. 9 is a view similar to that of FIG. 4 but, illustrating a modified form of trim member arranged for use as a chair rail.

FIG. 9 illustrates a chair rail trim 270 that is arranged in the manner similar to the base trim of FIG. 4 with like parts being given like reference numerals.

Comparing FIGS. 4 and 9, it will thus be seen that the chair rail trim 270 comprises a trim member 130A having the upper trim wall 132, the anchor wall 142, and the brace flanges 148 and 150 of the trim member 130, with the trim member 130A being formed to define the slot 140 that is adapted to receive the seal strip member 168 of FIG. 4.

In the trim member 130A, the lower trim wall 134A is given the same shape and function as trim wall 132 so as to define marginal edge 182A that engages the sheeting 70 when the trim member 130A is secured in place to serve as a chair rail.

Figure 10:
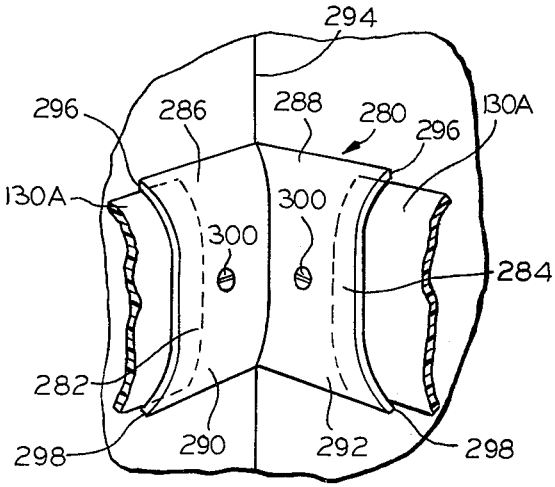
FIG. 10 is a view similar to that of FIG. 5, illustrating the application of two of the chair rail trim members in the form of FIG. 9 to an internal corner trim section, following the general arrangement of FIG. 5, but for chair rail application.

At room corners, the adjacent ends of chair rail trims 270 are accommodated in the same manner as the base trim members 100 and 130. FIG. 10 illustrates a corner trim section 280 of one piece construction defining trim walls 282 and 284 that are generally similar to the trim walls 212 and 214 of the corner section 206 except that both the upper and lower portions 286, 288, 290 and 292 are arced rearwardly of the corner section for application against the sheeting 70 in overlying relation to spaced apart but adjacent ends of trim members 130 extending into adjacency at an internal corner 294. The corner section 280 includes screw openings and bracing flanges (not shown) comparable to openings 222 and flanges 228 and 230 of corner section 206. The trim walls 282 and 284 define upper and lower marginal edges 296 and 298 that are in coplanar relation for application against the sheeting 70 when the screws 300 are turned into place (into sheeting 70).

Corner sections for external corners involve modifying corner section 280 in the manner suggested for the base trim corners in FIGS. 7 and 8.

Figure 11:
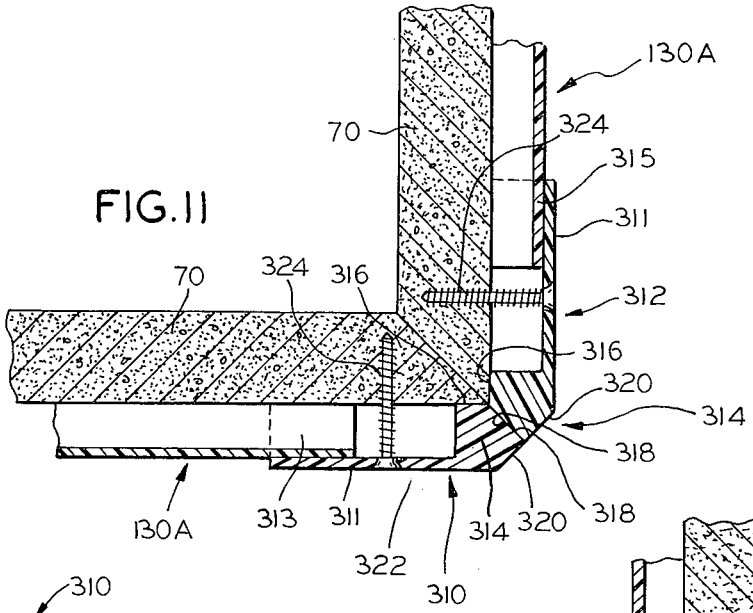
FIG. 11 illustrates a modified form of chair rail type trim corner section applied to an external corner of a partitioning arrangement.
Figure 13:
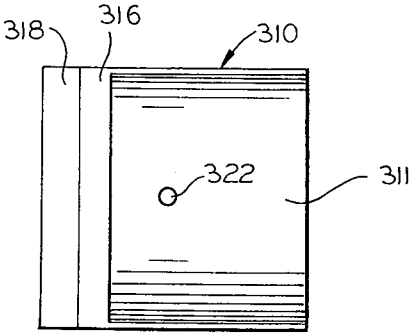
FIG. 13 is an elevational view of the inside surfacing of one of the identical segments forming the corner section of FIGS. 11 and 12.
Figure 12:
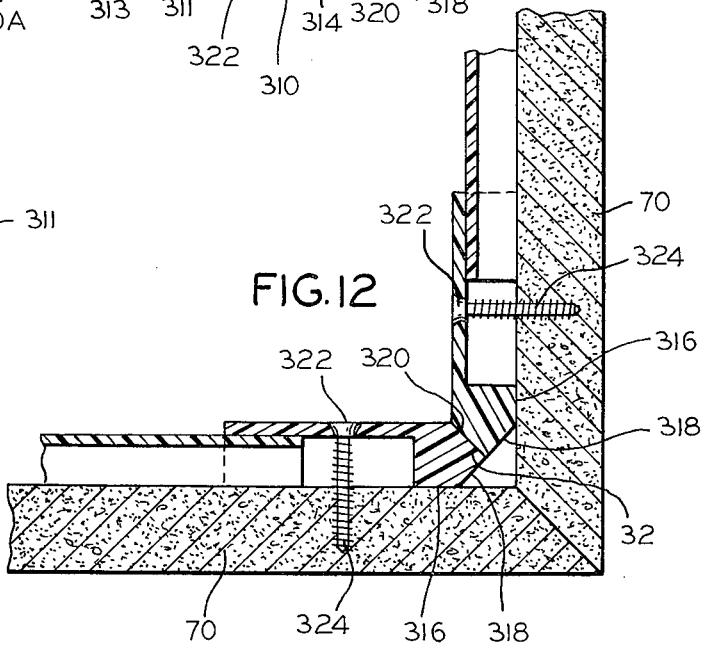
FIG. 12 is similar to that of FIG. 11, but shows the corner section arrangement of FIG. 11 as applied to an internal corner of a partitioning arrangement.

In the form of FIGS. 11 – 13, the chair rail trim members 130A have their adjacent ends covered by segments 310 and 312 that make up a composite corner section 314. The corner section 314 has its segments 310 and 312 shaped so that both external and internal corners can be accommodated, in the manner indicated in FIGS. 11 and 12, by the same pairs of segments 310 and 312.

The segments 310 and 312 each include a trim wall 311 comparable to the respective walls 282 and 284 of the corner section 280, which walls 311 are thus shaped to be received over and against the adjacent but spaced apart ends 313 and 315 of the trim members 130A. Sections 310 and 312, however, are separate but identical components in which the respective trim walls 311 are each formed with a seating surface 316 that is to engage the sheeting 70, seating surface 318 that are to engage together when the corner section 310 is applied at an external corner (see FIG. 11), and seating surfaces 320 that are to engage when the corner section 310 is to be applied at an internal corner (as indicated in FIG. 12).

The trim wals 311 are formed with suitable screw openings 322 to receive the suitable screws 324 for securing the corner section segments in place (to the sheetings 70) in the manner indicated in FIGS. 11 and 12.

The corner trim section 310 thus permits the same corner section to be used for both internal and external corners. FIG. 13 shows segment 312 and segment 310 are identically shaped.

The corner sections illustrated are preferably formed from rigid vinyl by a suitable injection molding procedure, and their walls are of adequate thickness so that the corner sections are of a rigid nature.

Figure 14:
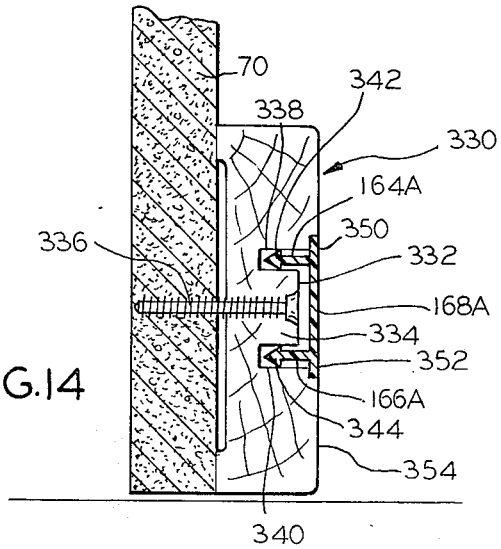
FIG. 14 illustrates a wooden trim member formed to accommodate a seal strip of the type shown in FIGS. 4 and 9 for the purpose of masking fasteners employed to fasten the base trim of FIG. 14 to a wallboard.

In the showing of FIG. 14, a wooden base trim member 330 is recessed as at 332 to define the central anchor section 334 through which suitable attachment screws 336 are applied and into sheeting 70 to secure the trim member 330 in position.

The recess 332 includes spaced apart parallel troughs 338 and 340 to receive the lugged portions 342 and 344 of seal strip member 168A.

The lug portions 342 and 344 of the seal strip 168A are similar to the corresponding portions of seal strip 168 except that they project from either side of the respective flanges 164A and 166A and are proportioned for jamb fitting into the respective troughs 338 and 340 of the recess 332.

The trim member 330 is recessed at 350 and 352 along the upper and lower edges of the recess 332 so that the trim strip trim wall 170 seats flush with the outward facing surface 354 of the trim member 330. Seal strip 168A, except for its lugged portions 342 and 344, is the same as seal strip 168 and extends the length of trim member 330, as does its groove 332.

Figure 15:
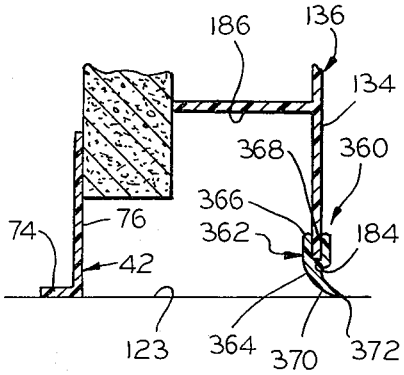
FIG. 15 illustrates a cove shoe for application to the base trim of FIG. 4.

In FIG. 15, a cove shoe 360 is illustrated and shown applied to lower edges 184 of trim member 130, for the purpose of providing a finished convexly rounded edging along the base trim where it meets a floor surface. The cove shoe 360 comprises a supplemental trim member 362 formed from a suitable soft vinyl, as by employing a suitable extrusion process, to define an elongate body 364 having its edge 366 slotted as at 368 to frictionally receive the trim wall 134 along its edge 184, with the body defining a tapering flange or lip 370 that terminates in knife edge 372.

The cove shoe 360 is employed in kitchens and bathrooms, or the like, to facilitate cleaning. Where it is to be applied, the members 362 are cut in lengths to correspond to the lengths of the trim members 130 employed in the room in question, and the individual members 362 are applied to the respective trim members 130 involved before the latter are secured in place. The trim members 130 are then secured in place on the wallboard so that the cove shoe members 362 bear against the floor surface 123, in the manner indicated in FIG. 15. Members 362 are suitably mitered at the room corners (not shown).

It will therefore be seen that the invention provides a trim arrangement for interior building partitions adapted for ready application to dry wall sheeting by utilizing conventional high-low thread dry wall screws, with the application being to the trim member at a recessed anchor wall that is masked by a snap fit in place seal strip which is flush with the trim walls of the trim member and thus is internally seated within same for securement against accidental dislodgement.

The trim arrangement involved has modifications suitable for either a base trim or chair rail trim, and at interior and exterior corners, corner sections are provided which are secured to the partition sheeting free and independent of the trim members and in slip fit relation thereto to accommodate relative movement therebetween.

The corner sections avoid mitering problems in connection with the trim members and accommodate relative movement in buildings. The seal strip completely covers the securing screws, which may be applied at random along a continuous anchor wall which is hidden by the seal strip thereby avoiding having to fill up or touch up screw holes.

The flexible nature of the trim members adapts to accommodate both straight and curved walls.

In the showing of FIG. 2, the wallboard sheeting 70 is shown indented at 83 for the slip fit engagement with the floor and ceiling runners. However, such indenting is ordinarily not necessary; it is shown in FIG. 2 primarily because the thickness of the runners and trim members is there made out of proportion to better distinguish the parts involved. FIG. 4 is more closely representative of the proportioning involved.

The base and chair rail trims hereindisclosed that are formed from rigid vinyl are preferably extruded to have wall thicknesses on the order of one sixteenth of an inch to provide the resilient flexibility contemplated by this invention.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. A trim strip for application to a vertical wall surface of a building interior partition, said trim strip comprising:

an elongate trim member of generally planar configuration and porportioned to be disposed flush against the partition wall surface, said trim member having a forwardly facing side facing away from the wall surface when said member is applied thereto and a rearwardly facing side that faces the wall surface when said member is applied thereto, said trim member defining a centrally located anchoring wall disposed between upper and lower trim walls disposed one on either side of said anchoring wall, said walls extending longitudinally of said trim member, said trim walls adjacent said anchoring wall defining generally coplanar trim surfaces that parallel the plane of said member and are located on the outward facing side of said member, said anchoring wall being offset inwardly of the trim member relative to said trim walls to be disposed on the rearwardly facing side of said member, said anchoring wall being generally planar and defining a planar seating surface on the rearwardly facing side thereof adapted to seat against the partition wall surface and which substantially parallels the plane of said member, said trim member along said anchoring wall defining an outwardly opening slot exposing said anchoring wall for applying through same fastener means to secure said trim member to the partition with said anchoring wall seating surface flush against the partition wall surface, said trim member on said rearwardly facing side including a pair of brace flanges extending normally of the plane of and rearwardly of said trim member and disposed one on either side of and extending in spaced parallel relation to said anchoring wall, said brace flanges having their rearwardly extending marginal edges disposed in the plane of said anchoring wall seatng surface, said anchoring wall being broad in the plane of said trim member as compared to said brace flanges for random application of fastener means thereto to secure said member to the partition, and a sealing strip proportioned to be closely received in said slot for masking said anchoring wall and fastener means, said sealing strip defining an outwardly facing generally planar front surface, said trim member and said strip including means for snap fit locking of said strip within said member slot with said strip being recessed within said slot with said surface thereof being in substantially coplanar relation with said trim wall surfaces, whereby said sealing strip is locked within the plane of said trim member and is free of protrusion outwardly of same, said member on either side of said slot being indented to define on either side of said slot in parallelism thereto planar surfaces paralleling said trim walls.

said sealing strip defining a masking wall formed with side edges coextensive with same proportioned to seat in said trim member indentations against said planar surfaes thereof, said locking means comprising:

said trim member being formed to define along said slot a pair of opposed, spaced apart, projecting stub flanges that are in coplanar relation with said trim member and have squared edge portions that oppose each other, said stub flanges extending lengthwise of said slot and being spaced forwardly of said anchoring wall, said sealing strip including a pair of spaced apart locking flanges projecting from the rearwardly facing side of same and each including a laterally projecting lug portion adapted to be received behind the respective trim member stub flange edge portions when said sealing strip is received in said slot, said locking flange lug portions each being formed with a cam surface for camming engagement with the respective stub flanges and said locking flanges defining internal squared corners that receive the respective stub flange edge portions whereby said sealing strip may be press fitted into place by positioning same to dispose said cam surfaces against the respective stub flange and finger pressing said sealing strip rearwardly of said trim member to snap said locking flange lug portions past said stub flange edge portions to mount said strip within said slot, and said stub flange edge portions and said locking flange squared corners interfit to preclude separation of said sealing strip from said trim member due to building movement, said stub flanges and said sealing strip flanges being located relative to said trim member trim surfaces and said sealing strip front surface to space said locking means and said stub flanges from said anchoring wall in the asembled relation of said anchoring wall.

2. The trim stip set forth in claim 1 wherein:

one of said trim walls arcs convexly rearwardly of said member for engagement with the partition wall surface and defines a marginal edge portion paralleling said member that projects to the plane of said anchoring wall, and the other of said trim walls substantially parallels said surface thereof along the width of same and terminates in a marginal edge adapted to engage a floor surface at the lower margin of the partition.

3. The trim strip set forth in claim 1 wherein:

both of said trim walls arch convexly rearwardly of said member for engagement with the partition wall surface and define a marginal edge portion paralleling said member that project to the plane of said anchoring wall.

4. A trim strip arrangement for application to vertical wall surfacing of building interior partitioning forming a room space having a vertically disposed corner, said trim strip comprising:

an elongate trim member of generally planar configuration and proportioned to be disposed flush against the partitioning wall surfacing, said trim member having a forwardly facing side facing away from the wall surfacing when said member is applied thereto and a rearwardly facing side that faces the wall surfacing when said member is applied thereto, said trim member defining a centrally located anchoring wall disposed between upper and lower trim walls disposed one on either side of said anchoring wall, said walls extending longitudinally of said trim member, said trim walls adjacent said anchoring wall defining generally coplanar trim surfaces that parallel the plane of said member and are located on the outward facing side of said member, said anchoring wall being offset inwardly of the trim member relative to said trim walls to be disposed on the rearwardly facing side of said member, said anchoring wall being generally planar and defining a planar seating surface on the rearwardly facing side thereof adapted to seat against the partitioning wall surfacing and which substantially parallels the plane of said member, said trim member along said anchoring wall defining an outwardly opening slot exposing said anchoring wall for random application through same fastener means to secure said member to the wall surfacing in horizontally disposed relation with said anchoring wall seating surface flush against the partitioning wall surfacing, a sealing strip proportioned to be closely received in said slot coextensive with said trim member for masking said anchoring wall and the fastener means, said sealing strip defining an outwardly facing generally planar front surface, said trim member and said strip including means for snap fit locking of said strip within said member slot with said strip being recessed within said slot with said surface thereof being in substantially coplanar relation with said trim wall surfaces, whereby said sealing strip is locked within the plane of said member and is free of protrusion outwardly of same, and a corner trim component for application to the partitioning wall surfacing at the corner, and between an end of said trim member disposed adjacent the corner on one side of the corner and an adjacent end of a like trim member applied to the wall surfacing in horizontal alignment therewith, said corner trim component comprising:

a trim section of right angled configuration defining intersecting trim walls proportioned to complement the outwardly facing configuration of said trim member and the like trim member with said strip of each trim member received in the respective slots of the trim members, said trim section being formed to receive fastener means for securing same to the wall surfacing and across the corner free of connection to the trim members with said trim walls of said trim section in overlying slip fit relation to the adjacent ends of the trim members, said trim section at said intersection of said trim walls thereof defining a corner for interfitting self locating relation with the partitioning corner independent of the slip fit relation of said trim section to the trim member adjacent ends, whereby relative movement of the partitioning wall surfacing to which the trim members are applied is accommodated by the slip fit between the trim members and said trim section free of gap formation in the trim arrangement at the corner.

5. The trim strip arrangement set forth in claim 4 wherein:

said trim member on said rearwardly facing side includes a pair of brace flanges extending normally of the plane of and rearwardly of said trim member and disposed one on either side of and extending in spaced parallel relation to said anchoring wall, said brace flanges having their rearwardly extending marginal edges disposed in the plane of said anchoring wall seating surface, said anchoring wall being broad in the plane of said trim member as compared to said brace flanges.

6. The trim strip set forth in claim 2 including:

a cove shoe applied to said marginal edge of said other trim wall for engaging the floor surface.

7. The trim strip set forth in claim 6 wherein:

said cove shoe is formed from a soft vinyl and is slotted longitudinally thereof for friction fit engagement on said other trim wall marginal edge.

8. A trim strip arrangement for application to vertical wall surfaces of two adjacent interior partitions intersecting at a corner, said trim strip arrangement comprising, in combination with the partitions:

a pair of elongate trim members of general planar configuration and fixed flush against the respective wall surfaces of the respective partitions in horizontally disposed coplanar relation with adjacent ends of same being adjacent to but spaced from the corner, said trim members each having a forwardly facing side facing away from the respective partition wall surfaces and a rearwardly facing side that faces the respective wall surfaces, said trim members each defining:

a centrally located anchoring wall disposed between upper and lower trim walls disposed one on either side of said anchoring wall, said trim member walls extending longitudinally of the respective trim members, said trim walls of the respective members adjacent said anchoring wall thereof defining generally coplanar trim surfaces that parallel the planes of the respective members and that are located on the respective outward facing sides of the respective trim members, said anchoring walls of the respective trim members being offset inwardly of the respective trim members relative to said trim walls thereof to be disposed on the respective rearwardly facing sides of said trim members, said anchoring walls of the respective trim members being generally planar and each defining a planar seating surface on the rearwardly facing side thereof seating against the respective partition wall surfaces and which substantially parallel the planes of the respective members, said trim members along their respective said anchoring walls each defining an outwardly opening slot exposing the respective anchoring walls with said anchoring walls having random applied through same fastener means to secure the respective trim members to the respective partition wall surfaces with said anchoring wall seating surfaces flush against the respective partition wall surfaces, and a sealing strip for the respective members with each strip being proportioned to be closely received in said slot of the respective members for masking said anchoring wall and fastener means thereof, said sealing strips each defining an outwardly facing generally planar front surface, said members and said strips respectively including means for snap fit locking of the respective strips within said member slots with said strips being recessed within said slots with said surfaces thereof being in substantially coplanar relation with said trim members and are free of protrusion outwardly of same, and a corner trim component secured to the partitions at the corner in horizontal alignment with said trim members, said corner trim component comprising:

a trim section of right angled configuration defining intersecting trim walls proportioned to complement the outwardly facing configuration of said trim members at said adjacent ends thereof with said strips received in said trim member slots, said trim section having fastener means securing same to the respective wall surfaces free of connection to said trim members, with said trim walls of same in overlying slip fit relation to said trim member adjacent ends, said trim section at the corner defining a corner for interfitting self locating relation with the partition corner independent of said trim member adjacent ends, whereby relative movement of the partition wall surfaces is accommodated by the slip fit between said trim members and said trim section and free of gap formation in said arrangement at the corner.

9. The trim strip arrangement set forth in claim 8 wherein:

said trim section is of one piece construction including the corner thereof, said trim section at said corner thereof including brace flange means proportioned to engage the respective partition surfaces.

10. The trim strip arrangement set forth in claim 8 wherein:

said trim section is of two piece construction having the pieces thereof in abutting relation at said corner thereof.

11. The trim strip arrangement set forth in claim 10 wherein:

said pieces of said trim section are formed for application to both internal and external partition corners.

* * * * *